US007449986B2

(12) United States Patent
Yamaguchi et al.

(10) Patent No.: US 7,449,986 B2
(45) Date of Patent: Nov. 11, 2008

(54) PLANAR COIL COMPONENT, METHOD FOR WINDING END CONNECTION THEREOF AND RESONANCE TRANSFORMER

(75) Inventors: Kenichi Yamaguchi, Tokyo (JP); Masaaki Iwakura, Tokyo (JP); Toru Kuramochi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/873,714

(22) Filed: Oct. 17, 2007

(65) Prior Publication Data

US 2008/0100407 A1 May 1, 2008

(30) Foreign Application Priority Data

Oct. 27, 2006 (JP) ..... 2006-293071

(51) Int. Cl.
*H01F 27/29* (2006.01)

(52) U.S. Cl. ..... 336/192; 336/208; 336/198

(58) Field of Classification Search ..... 336/208, 336/192, 198, 212
See application file for complete search history.

(56) References Cited

U.S. PATENT DOCUMENTS 3,701,961 A * 10/1972 Folk ..... 336/192
4,719,440 A * 1/1988 Nakamura et al. ..... 336/192
5,200,731 A * 4/1993 Tochio et al. ..... 336/98
6,010,362 A * 1/2000 Caviness et al. ..... 439/567
6,400,132 B1 * 6/2002 Koumura ..... 324/146
6,837,732 B2 * 1/2005 Pavlovic et al. ..... 439/352

FOREIGN PATENT DOCUMENTS

JP 57149709 A * 9/1982
JP 7-161462 A 6/1995

* cited by examiner

*Primary Examiner*—Anh T Mai
(74) *Attorney, Agent, or Firm*—Leydig, Voit & Mayer, Ltd.

(57) ABSTRACT

A planar coil component includes terminal metal fittings that include a crimping part, a terminal part, and a junction, and a bobbin on which a winding is wound. The bobbin has a terminal board including insertion holes. The terminal part is inserted from an upper surface of the terminal board into the insertion holes with the junction exposed, so that the terminal part projects from a bottom surface of the terminal board, each end of the winding is inserted into the crimping part through a slot in the bottom surface of the terminal board, and crimped. The winding is one of a litz wire, a stranded wire, and a parallel wire, and welded at an end tip and connected to the terminal metal fitting.

18 Claims, 5 Drawing Sheets

PLANAR COIL COMPONENT, METHOD FOR WINDING END CONNECTION THEREOF AND RESONANCE TRANSFORMER

BACKGROUND OF THE INVENTION

1. Field of the Invention

The present invention relates to a planar coil component used as a large current planar transformer (e.g., a resonance transformer used in a resonance type power supply) or as a choke coil etc., to a method for winding end connection thereof and to a resonance transformer.

2. Description of the Related Art

Thin planar transformers are required for power supplies used in such devices as flat panel televisions etc. Because of the large amount of current in resonance transformers, litz wire, stranded wire or parallel wire etc. where multiple wires thickly bundled together, are used for windings. Generally the process for connecting winding ends to the terminals involves binding and soldering the winding ends of a litz or stranded wire etc. to the terminals (pin terminals) disposed on a terminal board of a bobbin. However, the process has the following problems.

(1) When binding the winding ends to the terminal sticking out from a bottom surface of the terminal board an excessive height for a bundled part of the terminal is required and it hinders lowering the height of products.

(2) In order to lower the height of products, a structure using L-pin type terminals with the winding ends bundled and soldered to the flat part of the L-pin type terminals is well known. But when binding and soldering litz wires, stranded wires or parallel wires in a contiguous terminal structure, adjacent bundled up portions of the wires are easily short-circuited in case of soldering. It causes a reduction in quality and reliability, and workability of the soldering also deteriorates.

(3) In order to lower the height of products, even when using L-pin type terminals, the bundled up portion where litz wires, stranded wires or parallel wires bind is of a considerable size. Thus lowering the height of the products is problematic. Even when binding the winding end to a horizontal part of the terminal, it is still necessary to make the terminal board thicker (or make a standoff larger) so that the bundled portion does not stick out from an underside of the terminal board.

(4) When a litz wire, a stranded wire or a parallel wire used for large current is bundled to a pin terminal, there have been problems in workability and quality (a bundled part may be unraveled easily until soldering etc.) because wires are wound on a bobbin and wire ends dispersed to each pin.

(5) When a litz wire, a stranded wire or a parallel wire used for large current is bound and soldered to a pin terminal, it is difficult to form an alloy layer of solder and copper of a winding (it is difficult for soldering that the solder soaks into bundles of thin copper wires). Thus, soldering workability and quality have been problematic.

(6) When a litz wire, a stranded wire or a parallel wire is wound around a bobbin and bundled to terminals, the wire the length of which is for bundling is wasted.

As other example than bundling ends of windings, a method which a primary winding end is clamped for connection to a primary winding terminal is disclosed in Patent Document 1.

[Patent Document 1] Japanese Patent Application Laid-open No. 7-161462.

In Patent Document 1, the primary winding terminal is clamped to a bottom of a mounting side of a bobbin (specific configuration of clamping is not shown). The primary winding end is clamped by a forked clamping part of the primary winding terminal, and it is soldered by passing it through a soldering tank. The method in Patent Document 1 has the following problems.

(1) The primary winding terminal is disposed on the bottom of the mounting side of the bobbin. After the bobbin is mounted to a device board, the terminal is sandwiched between the device board and terminals board of the bobbin, thus it is difficult to dissipate heat from the terminals. When a large current flows through the winding, a problem of heat generation between the terminal and the winding end occurs. The structure does not solve the problems.

(2) The terminal board of the bobbin and the terminal structure correspond to a vertical type transformer (a magnetic core stands vertically with respect to a mounting surface), therefore, the structures are unsuitable for a horizontal type low height transformer i.e., a planar transformer (a magnetic core is parallel to a mounting surface).

(3) Secondary terminals are important for a resonance transformer but there is no ingenious design for secondary terminals disclosed in Patent Document 1.

SUMMARY OF THE INVENTION

Under such circumstances, the first object of the invention is to provide a planar coil component, a method for winding end connection thereof and a resonance transformer, which does not require winding end bundling operation, can lower a height thereof even when using a thick litz wire etc. and can improve heat dissipation.

Furthermore, the second object of the invention is to provide a planar coil component, a method for winding end connection thereof and a resonance transformer, which can improve connecting process workability of winding end connection in case of using a thick litz wire etc., can alloy solder with a metal of the winding end (solder can soak into and weld to a metal surface of the winding end) and firmly connect the winding end to a terminal by welding.

The other objects as well as new features of the invention are described in embodiments mentioned below.

To achieve the above-mentioned objects, the planar coil component of an embodiment of the invention comprises a plurality of terminal metal fittings that include a crimping part a terminal part and a junction, and a bobbin to which windings are wounded. The bobbin has a plurality of insertion holes which are formed on a terminal board. The terminal part is inserted from an upper surface of the terminal board into the insertion hole(s) with the junction exposed, so that the terminal part is caused to project from a bottom surface of the terminal board; each end of the winding is inserted into the crimping part through a slot in the bottom surface of the terminal board, and crimped; and the winding is one of a litz wire, a stranded wire and a parallel wire, and welded from an end tip thereof so as to be connected to the terminal metal fitting.

In the planar coil component, the winding may be welded by one of soldering, arc welding and laser welding.

In the planar coil component, the terminal parts may include a plurality of metal pieces extending from the junctions.

In the planar coil component, the crimping part may include a pair of metal pieces formed on a tip part of the junction, and a hole may be formed in the tip part of the junction and in one or both of the pair of metal pieces of the crimping part.

In the planar coil component, a guide projection may be formed along the insertion holes on the upper surface of the terminal board.

In the planar coil component, the plurality of terminal metal fittings may be installed on a part of the terminal board and pin terminals are installed on other part of the terminal board.

A resonance transformer in another embodiment of the invention comprises a plurality of terminal metal fittings that include a crimping part, a terminal part and a junction, and a bobbin to which a primary and a secondary winding are provided so that a gap is set up between the primary winding and the secondary winding. The bobbin has a terminal board in which a plurality of insertion holes are formed. The terminal part is inserted from an upper surface of the terminal board into the insertion hole(s) with the junction exposed, so that the terminal part is caused to stick out from a bottom surface of the terminal board; each end of the secondary winding is inserted into the crimping part through a slot in the bottom surface of the terminal board, and crimped; and the secondary winding is one of a litz wire, a stranded wire and a parallel wire, and welded from an end tip thereof so as to be connected to the terminal metal fitting.

In the resonance transformer, the secondary winding may be welded by one of soldering, arc welding and laser welding.

In the resonance transformer, a magnetic core may be attached to the bobbin; and an insulation cover may be mounted on the bobbin, to provide insulation between each winding and the magnetic core, and to provide insulation between the primary winding and the secondary winding, A method for winding end connection of a planar coil component according to the other embodiment of the invention comprises a metal fitting insertion step that uses a plurality of terminal metal fittings including a crimping part, a terminal part and a junction, and a bobbin having a terminal board, wherein the terminal part is inserted from an upper surface of the terminal board into an insertion hole(s) formed in the terminal board; a metal fitting crimping step in which a winding is one of a litz wire, a stranded wire and a parallel wire, wound on the bobbin, and each end of the winding is inserted into the crimping part through a slot in a bottom surface of the terminal board and crimped; and a connection step in which each end of the winding is welded from the tip of the each end of the winding so as to be connected to the terminal metal fitting so that the terminal metal fitting is fixed to the terminal board.

DETAILED DESCRIPTION OF THE INVENTION

The invention will be described by reference to a preferred embodiment. This does not intend to limit the scope of the present invention, but to exemplify the invention.

The preferred embodiment according to the invention relates to a planar coil component, method for winding end connection thereof and resonance transformer.

Figure 1:
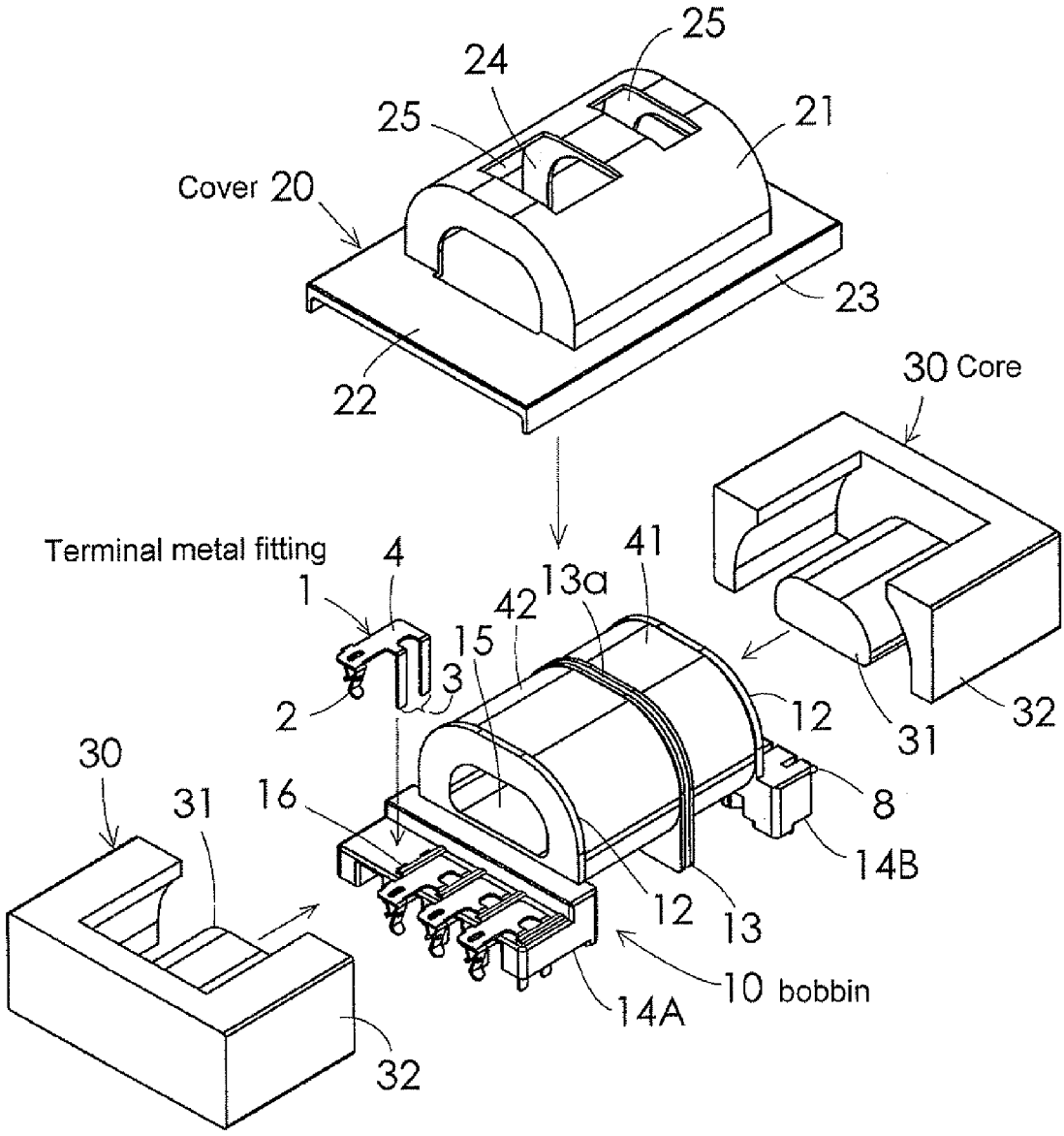
FIG. 1 is a top exploded perspective view showing an embodiment of the invention.
Figure 2:
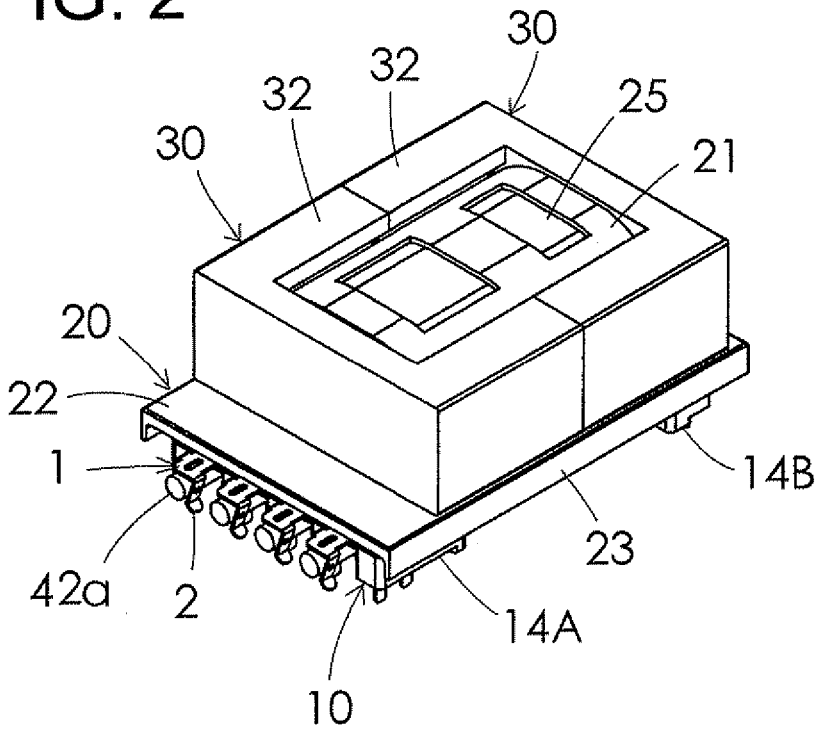
FIG. 2 is a top perspective view of the assembled state of the embodiment of the invention.
Figure 3:
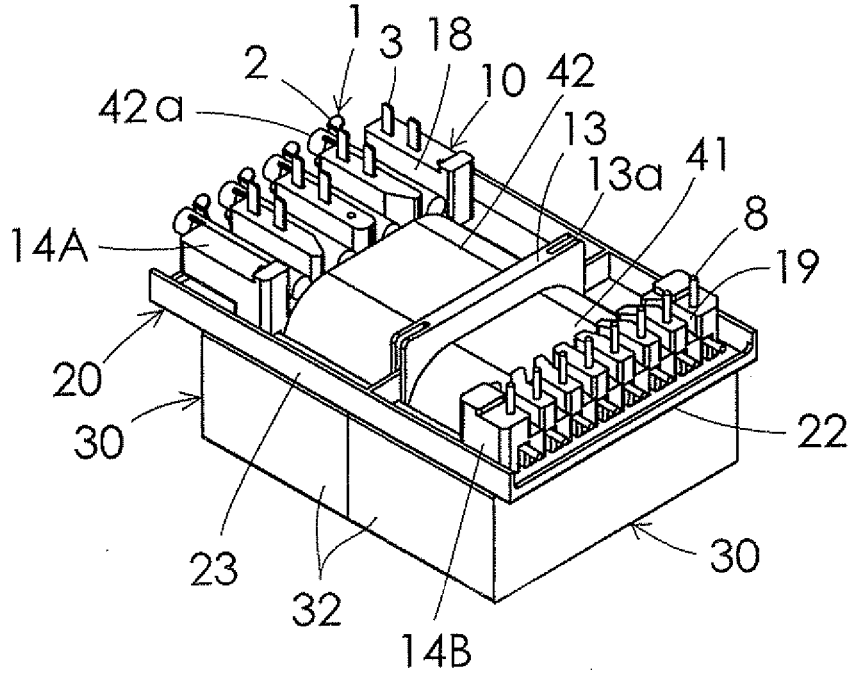
FIG. 3 is a bottom perspective view of the embodiment of the invention.
Figure 4:
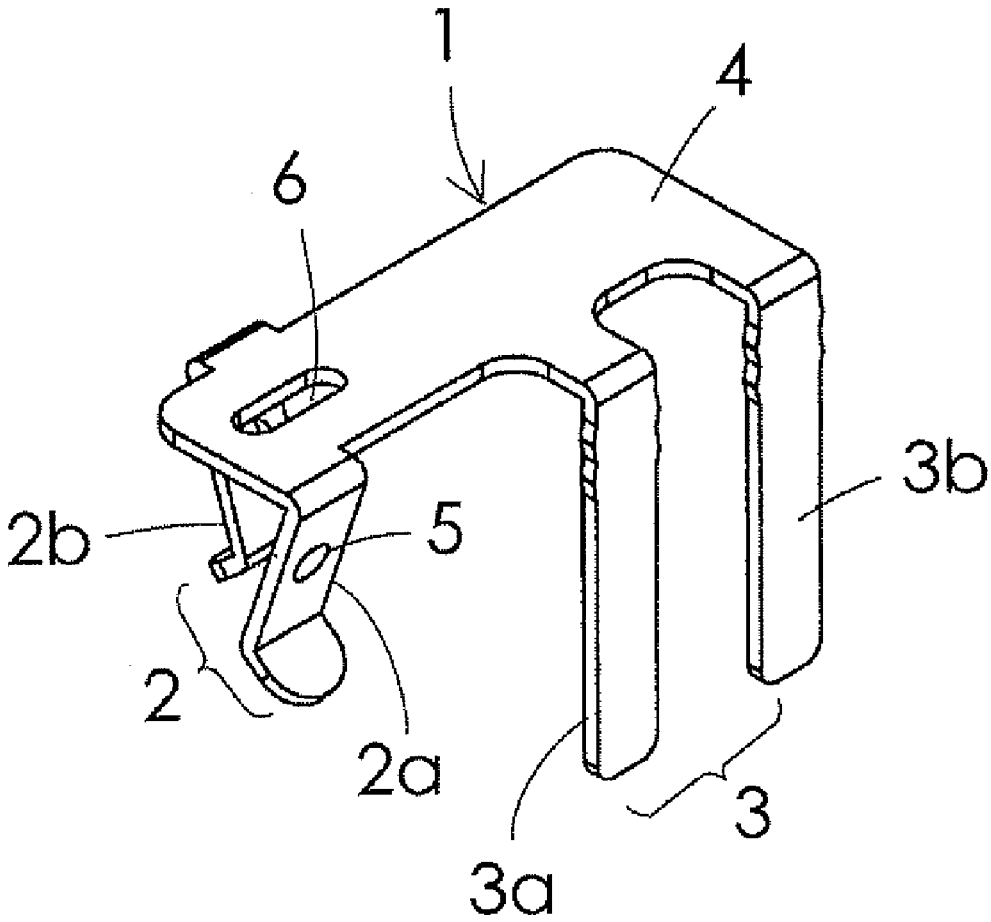
FIG. 4 is a perspective view of a terminal metal fitting of the embodiment.
Figure 5:
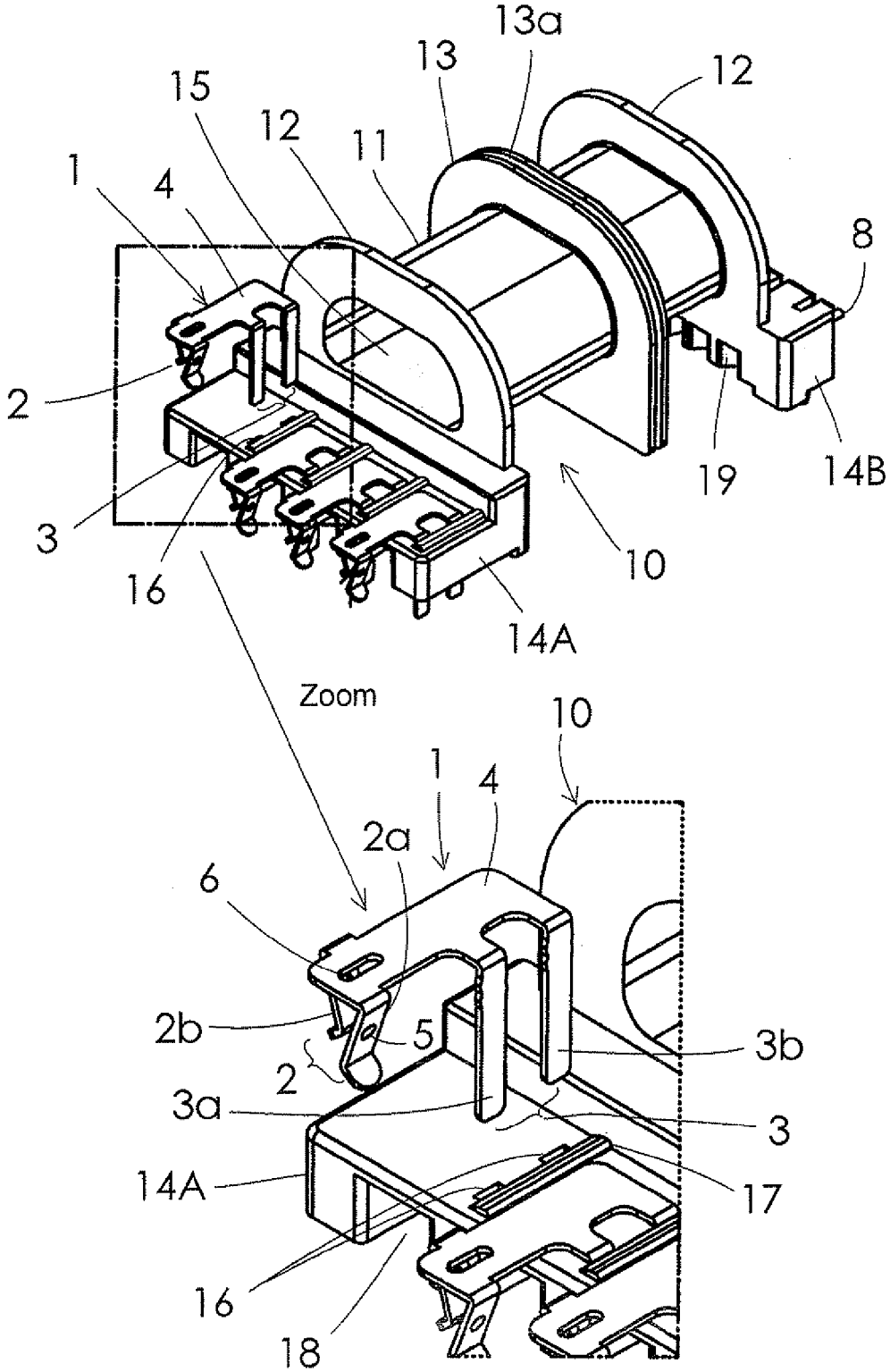
FIG. 5 is a perspective view of the terminal metal fitting and a bobbin of the embodiment.
Figure 6:
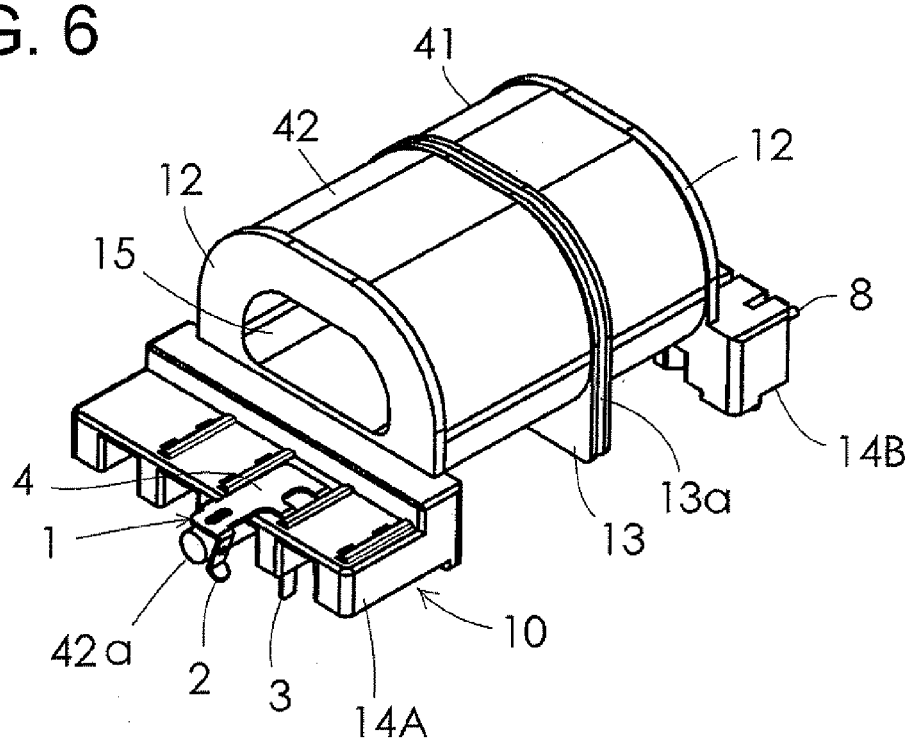
FIG. 6 is a top perspective view of the embodiment in which the winding end is crimped and held by the terminal metal fitting.
Figure 7:
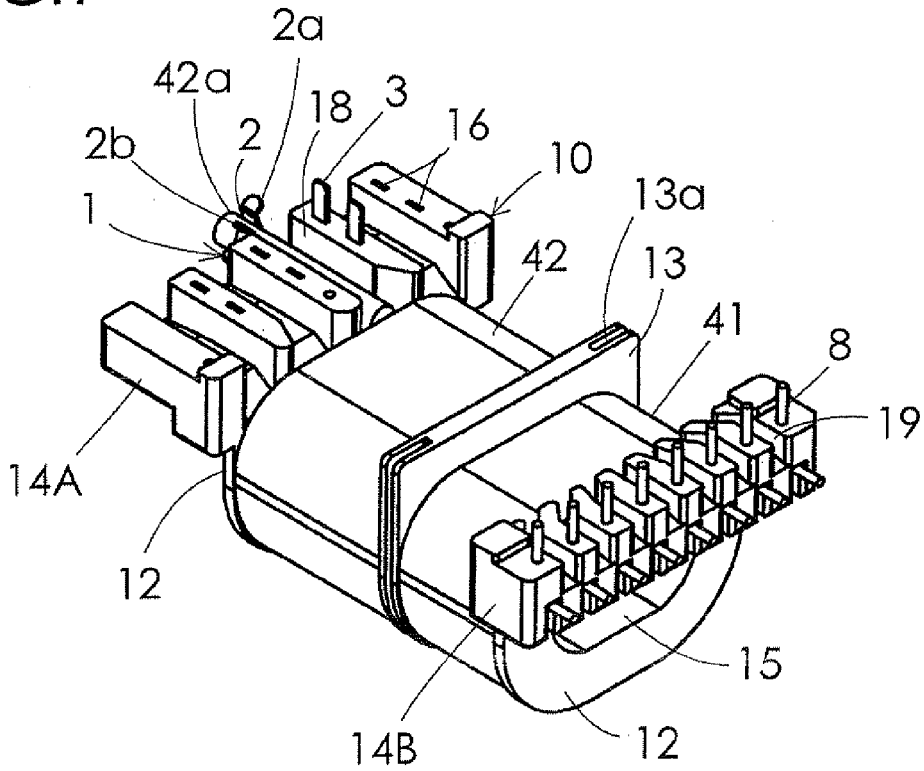
FIG. 7 is a bottom perspective view of the embodiment in which the winding end is crimped and held by the terminal metal fitting.

FIGS. 1 through 3 show the entire structure of a planar coil component, FIG. 4 shows a terminal metal fitting used therein, and FIGS. 5 through 7 show a bobbin with the terminal metal fittings installed.

The planar coil component in FIGS. 1, 2 and 3 is, as an example, constructed as a large current planar transformer suitable as a resonance transformer used in resonance type power supplies, and comprises a bobbin 10 in which a terminal metal fining 1 is installed, an insulation cover 20 mounted on the bobbin 10 after winding on the bobbin 10 and a pair of E-type cores 30 as magnetic cores attached to the bobbin 10 in a horizontal arrangement.

As shown in FIG. 4, the terminal metal fitting 1 is formed of a bent metal plate of copper or copper alloy (phosphor bronze) so that it has a crimping part 2, a terminal part 3 and a junction 4.

The crimping part 2 is composed of a pair of bent metal pieces 2*a* and 2*b* which are formed on a tip part of the flat junction 4 by bending. A space between the bent pieces 2*a* and 2*b* is narrow enough to insert and hold the winding end. Furthermore, locations of the pair of bent pieces 2*a* and 2*b* from the junction 4 are shifted backward and forward each other so that it is possible to crimp the winding end securely. Each tip part of the bent pieces 2*a* and 2*b* has tapered shape with the tip parts opened toward an apex direction so that it is easy to insert the winding end between the bent pieces 2*a* and 2*b* from the apex side of the bent pieces 2*a* and 2*b*.

The terminal part 3 is formed on one side edge at a rear part of the junction 4 by bending vertically with respect to the junction 4. Here, the terminal part 3 is composed of forked bent pieces 3*a* and 3*b* extending perpendicularly from the junction 4. The reason for the forked shape of the terminal part 3 is that when using a metallic eyelet on an opposite-side board (a device circuit board), a width of the terminal part 3 is limited by an inside diameter of the metallic eyelet, therefore, it must be of a width that can be inserted into an inner circumference of the metallic eyelet. Any current capacity is available with increase of a number of the bent pieces. Note that if slit hole processing is possible on the opposite-side board, one wide terminal part 3 composed of a single bent piece may be used.

Furthermore, holes 5 and 6 are formed respectively on the crimping part 2 and the junction 4 so that, when soldering, the heat from the soldering is efficiently transferred to the terminal metal fitting 1. The structure including holes 5 and 6 can contribute to improve workability of winding end connection and efficiency of heat conduction in case of using arc welding or laser welding other than soldering.

As shown in FIGS. 5 through 7, in order to make the E-type cores 30 possible to mount in a horizontal arrangement, the bobbin 10 is composed of a transverse (horizontal) cylindrical winding drum part 11, end flanges 12 formed on both ends of the winding drum part 11, an intermediate flange 13 in the middle of the winding drum part 11, and terminal boards 14*a* and 14*b* formed respectively on the end flanges 12 as a unit with the end flanges 12. The winding drum part 11 has an insertion hole 15 inside into which central legs 31 of the E-type cores 30 are inserted.

Insertion holes 16 are formed on the one terminal board 14A in order to insert the terminal part 3 (i.e., the forked bent pieces 3*a* and 3*b*) of the terminal metal fitting 1 of FIG. 4 from an upper part of the terminal board. Furthermore, a straight guide projection 17 which is guide for inserting the terminal part 3 is also formed along the edge of the insertion holes 16.

L-pin type terminals 8 are implanted on the other terminal board 14B. The L-pin type terminals 8 are used for ordinary connecting winding ends that have small current capacity and a general connection method of soldering, arc welding or laser welding etc. can be adopted in which the winding ends are bundled and welded with respect to the L-pin type terminals 8. Furthermore, slots 18 and 19 are respectively formed on bottoms (underneath) of the terminal boards 14A and 14B so that the winding ends are drawn in a horizontal direction (axial direction of the winding drum).

A large current planar transformer as a resonance transformer has at least a primary winding and a secondary winding, then for example, as shown in FIGS. 6 and 7, the secondary winding 42 is wound on an outer circumference of the winding drum between the one end flange 12 (terminal board 14A side) and the intermediate flange 13, while the primary winding 41 is wound between the other end flange 12 (terminal board 14B side) and the intermediate flange 13. The secondary winding 42 is a litz wire, stranded wire or parallel wire because a large current flows in it. Processing of the winding end will be described below.

As shown in FIGS. 1 through 3, an insulation cover 20 is one unit consisting of a semi-cylindrical cover part 21 which covers the bobbin 10 and the outer circumference of the winding wound around the bobbin 10, a plate cover part 22 which covers an upper surface of the terminal board and a side cover part 23 which covers the side of the bobbin 10. Additionally, a partition wall part 24 is formed inside of the semi-cylindrical cover 21 for insulation between the primary and secondary windings. The partition wall part 24 has a position and thickness to fit into a slot 13*a* formed continuously in a circumferential surface of the intermediate flange part 13. The slot 13*a* is positioned in an intermediate part in a thickness direction of the circumferential surface. The window 25 is opened on the semi-cylindrical cover part 21 to dissipate heat.

Next, an explanation is given regarding an assembling sequence of the large current planar transformer and the connecting method of the winding end.

As shown in FIG. 5, metal fitting insertion step is carried out wherein the terminal part 3 of the terminal metal fitting 1 is inserted into the insertion holes 16 on the one terminal board 14A from the upper surface thereof using the straight guide projection 17. That is, the junction 4 of the terminal metal fitting 1 is caused to be exposed on the upper surface of the terminal board 14A, and the terminal part 3 is caused to be projected a predetermined length from the bottom surface of the terminal board 14A. Note that the L-pin type terminals 8 are set up beforehand on the other terminal board 14B (e.g., insert mold formation or insertion into insertion holes).

When the mounting of the required number of terminal metal fittings 1 is completed, as shown in FIGS. 6 and 7, the secondary winding 42 and the primary winding 41 etc. are wound and processing the winding ends is carried out respectively. The metal fitting crimping step is carried out wherein the winding end 42*a* of the secondary winding 42, which is a large diameter litz wire, stranded wire or parallel wire, is drawn out in a horizontal direction (axial direction of the winding drum part) through the slot 18 of the terminal board 14A, inserted into the crimping part 2 of the terminal metal fitting 1 in a horizontal direction and secured here by crimping (clamped by crimping the pair of bent pieces 2*a* and 2*b*). In FIGS. 6 and 7, only processing of the one winding end 42*a* is shown but ultimately, as shown in FIGS. 2 and 3, crimping step is carried out with regard to all of the winding ends 42*a* of the secondary winding 42. Note that there are 4 winding ends 42*a* shown, this is because two windings are wound as the secondary winding 42 in order to carry large current. However, this does not mean that the winding ends 42*a* are limited to this number.

When the primary winding 41 is an ordinary single insulation-covered wire wound, the winding end of the primary winding 41 is bundle processed to the horizontal part of the L-pin type terminal 8 of the terminal board 14B.

In the subsequent connecting process, the winding end 42*a* and the terminal metal fitting 1 are electrically connected by welding (e.g., soldering, arc welding or laser welding) from the tip of the winding end 42*a* so that the terminal metal fitting 1 is secured to the terminal board 14A (indirectly secured by the soldering, arc welding or laser welding connection of the terminal fitting 1 and the winding end 42*a*). At this time, in case of soldering connection having done from the tip of the winding end 42*a*, a surface of each thin metal wire (copper wire) composing litz wires, stranded wires or parallel wires is soaked in and penetrated with solder, and it is possible to alloy the copper with the solder certainly. Furthermore, because the holes 5 and 6 are formed in the crimping part 2 and the junction 4 of the terminal metal fitting 1 as shown in FIG. 4, the soldering also penetrates into the holes 5 and 6, then it is possible to have excellent heat conduction to the terminal metal fitting 1 so as to have the solder adheres securely to the terminal metal fitting 1.

Additionally, another connecting process, in which the winding ends of the primary winding 41 on the side of the terminal board 14B are connected to the L-pin type terminals 8, can be carried out in a conventional manner.

After the connecting process is completed, the insulation cover 20 in FIG. 1 is mounted onto the wound bobbin 10 from the top so that the wound bobbin 10 is covered. At the time, the partition part 24 inside the semi-cylindrical cover part 21 is put in the slot 13*a* of the intermediate flange part 13. By doing it, the primary and secondary windings 41 and 42 are insulated from each other. Furthermore, the upper surfaces of the terminal boards 14A and 14B are covered by the plate cover part 22. The upper half and side surfaces of the primary and secondary windings 41 and 42 are covered by the semi-cylindrical cover part 21 and the side cover part 23.

After the insulation cover 20 is mounted onto the bobbin 10, the central legs 31 of the pair of E-type cores 30 are inserted into the insertion hole 15 inside the winding drum part 11 and as shown in FIGS. 2 and 3, by bringing the side legs 32 of the pair of E-type cores 30 together to integrate them as one unit, the large current planar transformer is completed. Note that in case of the resonance transformer used in a resonance type power supply, in addition to having a gap set up by the intermediate flange part 13 between the primary winding 41 and the secondary winding 42, a gap is also set up between the central legs 31 of the pair of E-type cores 30.

In a state that the pair of F-type cores 30 mounted on the bobbin 10, the insulation cover 20 can increase a creeping distance and a spatial distance between each of the windings 41 and 42 and the E-type cores 30, and can increase a creeping distance and a spatial distance between the E-type cores 30 and the terminal metal fitting 1 or the L-pin type terminal 8 that is set up on the terminal board 14A and 14B. That is, the required insulation performance for a power source transformer can be guaranteed.

According to the embodiment, it is possible to obtain the following effects.

(1) In the embodiment the transformer has a structure wherein the winding end 42*a* of the secondary winding 42, which is a litz wire, stranded wire or parallel wire used to carry large current, are not bundled to a pin but are drawn out horizontally (direction parallel to the axial direction of the winding drum), are inserted horizontally into the crimping part 2 of the terminal metal fitting 1 and are connected by soldering, arc welding or laser welding after crimping. Therefore, the structure is not affected by height of the bundled part and height of the connected part, a standoff of the terminal board is minimized and it is possible to lower the height of the product.

(2) When providing the winding onto the bobbin 10, there is no waste wire length due to bundling to the terminal, then no wire material is squandered.

(3) When bundling a litz wire, stranded wire or parallel wire used for a large current to a pin, the problem arises that the bundled part becomes loose before connecting by soldering, arc welding or laser welding etc. But in the embodiment, the winding end 42*a* is crimped and held by the crimping part 2 of the terminal metal fitting 1, the problem is avoided, workability improves and there is a concomitant improvement in quality.

(4) When bundling a litz wire, stranded wire or parallel wire used for large current to a pin, the problem has occurred in which each winding end of the thin metal wires (copper wires) that make up the litz wire, stranded wire or parallel wire become separated. But in the embodiment, separation of the wires is minimized and connection process by soldering, arc welding or laser welding is easily prosecuted because of crimping the winding end 42*a* with the crimping part 2.

(5) By soldering from the tip part of the winding end 42*a*, the solder soaks and penetrates both the surface of each of the metal wires (copper wires) composing the litz wire, stranded wire or parallel wire and the surface of the terminal metal fitting 1 (copper or copper alloy), and alloy layers of the solder with the copper or copper alloy are formed. Then it is possible to make secure connections with the soldering and it is possible to stabilize the quality. Furthermore, it is also possible to do soldering operations in the situation which the bobbin 10 stands vertically with good workability. Moreover, through visual inspection or by cutting the solder connection part of the terminal metal fitting 1 and the winding end 42*a*, it is easy to confirm the condition of the alloy layers.

(6) Because the winding end 42*a* which is an end of the litz wire, stranded wire or parallel wire used for large current is not bundled to a pin, no short circuiting of the adjacent terminals or contact of the bundled parts occurs when solder dipping, workability is improved and the quality is also stabilized.

(7) In addition to its function of holding and crimping the winding end 42*a*, the terminal metal fitting 1 also has a function of effectively dissipating heat generation when a large current flows. The terminal metal fitting 1 has a large surface area compared to a pin terminal, has excellent heat conductance property (because it is made of copper or copper alloy) and is inserted from the upper part of the terminal board 14A while the junction 4 is exposed to the upper surface of the terminal board 14A, then the terminal metal fitting 1 is effectively cooled by outside air.

(8) The insulation cover 20 is installed on the bobbin 10 making it possible to improve the insulation (increase a creeping distance and a spacial distance) between the primary and secondary windings 41 and 42 and the E-type cores 30 and to provide insulation between the primary winding 41 and the secondary winding 42.

(9) Because the terminal part 3 of the terminal metal fitting 1 are formed to be separated into a plurality of bent pieces (the bent pieces 3*a* and 3*b*), it is possible to insert them into the metallic eyelet holes on the opposite-side board making slit hole processing unnecessary.

(10) When the holes 5 and 6 are put on the end part of the junction 4 of the terminal metal fitting 1 and on one or both of pair of bent pieces 2*a* and 2*b* of the crimping part 2 thereof, the solder also penetrates the holes 5 and 6 allowing for excellent heat conduction to the terminal metal fitting 1 and making secure solder adhesion to the terminal metal fitting 1 possible.

(11) A straight guide projection 17 is formed on the upper surface of the terminal board 14A along the insertion holes 16 making the insertion operation of the terminal part 3 of the terminal metal fitting 1 into the insertion holes 16 easy to perform.

Note that in the embodiment a large current planar transformer suitable as a resonance transformer used in resonance type power supplies is constructed by providing primary and secondary windings on a bobbin, on the other hand a choke coil used for large current can be constructed if a single wire of litz wire, stranded wire or parallel wire used for large current is wound on a bobbin, and their winding ends are crimped in a manner similar to above terminal metal fitting and connected by soldering, arc welding or laser welding etc.

While the preferred embodiment of the present invention has been described using specific terms, such description is for illustrative purposes only, and it is to be understood that changes and variations may be made without departing from the spirit or scope of the appended claims.

As described above, according to the invention, because of installing the terminal metal fitting that contains a crimping part, a terminal part and a junction by inserting it from an upper part of a terminal board, crimping and securing a winding end by the crimping part and then welding for connection, no bundling operation of the winding end is necessary, the necessity to set up an excessive height of the bundled part no longer exists and low height is feasible, Furthermore, when the terminal metal fining is mounted on the terminal board, there is an exposed part (the part in contact with the outside air) on the upper surface of the terminal board allowing for excellent heat dissipation property and it is possible to suppress a rise in temperature of the terminal metal fitting and the winding end.

Furthermore, by eliminating a winding end bundling processing (bad workability when using large litz wire etc.), it is possible to improve connection process with good workability by welding, prevent short circuiting with adjacent terminals, provide a secure alloying of the winding end with the solder in case of soldering and further, it is possible to improve both the quality and reliability.

What is claimed is:

1. A planar coil component comprising:

a plurality of terminal metal fittings that include a crimping part, a terminal part and a junction; and a bobbin on which a winding is wound, the bobbin having a terminal board including a plurality of insertion holes, wherein:

the terminal part is inserted in the insertion hole(s) with the junction exposed, and the terminal part projects from a bottom surface of the terminal board, each end of the winding is located in the crimping part, passing through a slot in the bottom surface of the terminal board, and is crimped, and the winding is selected from the group consisting of a litz wire, a stranded wire, and a parallel wire, and is welded at an end tip and connected to the terminal metal fitting.

2. The planar coil component according to claim 1 wherein the winding is welded by one of soldering, arc welding, and laser welding.

3. The planar coil component according to claim 1 wherein the terminal part includes a plurality of metal pieces extending from the junction.

4. The planar coil component according to claim 1 wherein the crimping part includes a pair of metal pieces located on a tip part of the junction, and a hole in the tip part of the junction and in at least one of the pair of metal pieces of the crimping part.

5. The planar coil component according to claim 1 including a guide projection located along the insertion holes on an upper surface of the terminal board.

6. The planar coil component according to claim 1 wherein the plurality of terminal metal fittings are installed on a first part of the terminal board and including pin terminals installed on a second part of the terminal board.

7. A resonance transformer comprising:

a plurality of terminal metal fittings that include a crimping part, a terminal part, and a junction; and a bobbin on which a primary winding and a secondary winding are wound so that a gap is present between the primary winding and the secondary winding, the bobbin including a terminal board in which a plurality of insertion holes are located, wherein:

the terminal part is inserted in the insertion hole(s) with the junction exposed, and the terminal part projects from a bottom surface of the terminal board, each end of the secondary winding is located in the crimping part, passing through a slot in the bottom surface of the terminal board, and is crimped, and the secondary winding is selected from the group consisting of a litz wire, a stranded wire, and a parallel wire, and is welded at an end tip and connected to the terminal metal fitting.

8. The resonance transformer according to claim 7 wherein the secondary winding is welded by one of soldering, arc welding, and laser welding.

9. The resonance transformer according to claim 7 including:

a magnetic core attached to the bobbin; and an insulation cover mounted on the bobbin, to provide insulation between the primary and secondary windings and the magnetic core, and to provide insulation between the primary winding and the secondary winding.

10. The resonance transformer according to claim 7 wherein the terminal part includes a plurality of metal pieces extending from the junction.

11. The resonance transformer according to claim 7 wherein the crimping part includes a pair of metal pieces located on a tip part of the junction, and a hole in the tip part of the junction and in at least one of the pair of metal pieces of the crimping part.

12. The resonance transformer according to claim 7 including a guide projection located along the insertion holes on an upper surface of the terminal board.

13. The resonance transformer according to claim 7 wherein the plurality of terminal metal fittings are installed on a secondary side of the terminal board and including pin terminals installed on a primary side of the terminal board.

14. A method for winding end connection of a planar coil component comprising:

using a plurality of terminal metal fittings that include a crimping part, a terminal part, and a junction, and a bobbin having a terminal board, inserting the terminal part from an upper surface of the terminal board into an insertion hole(s) in the terminal board;

crimping each end of a winding of one of a litz wire, a stranded wire, and a parallel wire, wound on the bobbin, after inserting each end of the winding into the crimping part through a slot in a bottom surface of the terminal board; and welding each end of the winding from the tip of each end of the winding to be connected to the terminal metal fitting so that the terminal metal fitting is fixed to the terminal board.

15. The method according to claim 14 including welding the winding by one of soldering, arc welding and laser welding.

16. The method according to claim 14 wherein the terminal part includes a plurality of metal pieces extending from the junction.

17. The method according to claim 14 wherein the crimping part includes a pair of metal pieces located on a tip part of the junction, and a hole in the tip part of the junction and in at least one of the pair of metal pieces of the crimping part.

18. The method according to claim 14 wherein a guide projection is located along the insertion hole(s) on the upper surface of the terminal board.

* * * * *